US007757847B2

(12) United States Patent
Tang et al.

(10) Patent No.: US 7,757,847 B2
(45) Date of Patent: Jul. 20, 2010

(54) CREDIT-CARD-SIZED CARRIER OF BOTH STANDARD AND MICRO FORM-FACTOR FLASH-MEMORY CARDS

(75) Inventors: Choon Tak Tang, Irvine, CA (US); George K. L. Shiu, South Pasadena, CA (US)

(73) Assignee: Kingston Technology Corporation, Fountain Valley, CA (US)

( * ) Notice: Subject to any disclaimer, the term of this patent is extended or adjusted under 35 U.S.C. 154(b) by 1 day.

(21) Appl. No.: 12/134,024

(22) Filed: Jun. 5, 2008

(65) Prior Publication Data

US 2009/0301909 A1 Dec. 10, 2009

(51) Int. Cl.
*B65D 85/00* (2006.01)

(52) U.S. Cl. ..... 206/307.1; 206/701

(58) Field of Classification Search ..... 206/701, 206/477, 478, 480, 482, 493, 706, 707, 307, 206/307.1

See application file for complete search history.

(56) References Cited

U.S. PATENT DOCUMENTS 4,724,956 A * 2/1988 Ozeki ..... 206/307
4,916,434 A 4/1990 McNeely
5,161,827 A 11/1992 Grosso
5,373,944 A * 12/1994 Ishitsuka ..... 206/308.3
5,938,010 A 8/1999 Osterbye
6,230,885 B1 * 5/2001 Rochelo et al. ..... 206/308.3
6,427,836 B1 8/2002 Bolanos
6,587,348 B2 * 7/2003 Kondo ..... 361/741
6,601,329 B2 8/2003 Vaudreuil
6,724,618 B1 4/2004 Jenkins et al.
6,908,038 B1 6/2005 Le
6,920,338 B2 7/2005 Engstrom et al.
7,291,019 B2 11/2007 Nishizawa et al.
7,357,331 B2 4/2008 Blossom
2005/0077350 A1 4/2005 Courtion et al.
2005/0252969 A1 * 11/2005 Wu ..... 235/441
2005/0258068 A1 * 11/2005 Chien ..... 206/701
2006/0144751 A1 * 7/2006 Tsang ..... 206/707
2008/0007905 A1 1/2008 Wilcox et al.
2008/0087731 A1 4/2008 Gonzalez et al.

OTHER PUBLICATIONS

PROPORTA Ltd., Aluminum Memory/SIM Card Holder Product Info, 2008.

OTHER PUBLICATIONS

PDAir, SD and SIM Card Wallet, 2006.

* cited by examiner

*Primary Examiner*—J. Gregory Pickett
*Assistant Examiner*—Andrew Perreault
(74) *Attorney, Agent, or Firm*—Sawyer Law Group, P.C.

(57) ABSTRACT

A multi-standard flash-memory-card carrier is about the same size as a thick credit card and fits into a wallet. The multi-standard flash-memory-card carrier has bays that accept flash-memory cards. Larger bays on one side receive SD cards and a Memory Stick Duo card, while micro bays on another side of the carrier receive microSD cards and Memory Stick Micro cards. A carrier spine sandwiched between top and bottom covers has openings forming the bays. Spring-clip tabs on spring-clip fingers fit into notches on the side of the flash-memory cards to secure the flash-memory cards into the multi-standard flash-memory-card carrier to prevent loss. The spring-clip fingers are movable parts of the carrier spine that are deformed during insertion of the flash-memory cards. Both micro and standard flash-memory cards can be carried in the same multi-standard flash-memory-card carrier that can be placed in plastic sleeves for credit cards in a person's wallet.

19 Claims, 8 Drawing Sheets

CREDIT-CARD-SIZED CARRIER OF BOTH STANDARD AND MICRO FORM-FACTOR FLASH-MEMORY CARDS

FIELD OF THE INVENTION

This invention relates to electronics carriers, and more particularly to wallet-sized carriers for carrying small flash-memory cards.

BACKGROUND OF THE INVENTION

Small flash-memory cards have become wildly popular and have replaced floppy disks for data transport. Falling prices and advances in technology for flash-memory chips have allowed for larger memory capacities in multiple, diverse form factors, while advances in chip packaging have allowed for smaller physical sizes of flash-memory cards.

A flash-memory chip may be soldered to a printed-circuit board (PCB) or a flex carrier substrate that is then encased in a plastic shell that exposes metal contacts. The metal contacts make contacts with a connector plug when the flash-memory card is plugged into a host, such as a personal computer (PC), cell phone, digital camera, or other computing device. A flash controller may be integrated with the flash-memory chip, or may be a separate chip soldered to the PCB or flex carrier. For writes, the flash controller receives commands, address, and data carried from the host over a host bus to the metal contacts, and sends corresponding control, address, and data signals to the flash-memory chip.

A number of protocols are used for the host bus, and standards have been developed that specify the physical dimensions of the device as well as the host-bus protocol. Older standards such as compact-flash (CF) specified large, thick devices, while more recent standards such as Secure Digital (SD) and Sony's Memory Stick significantly reduced the device thickness.

Further improvements in packaging and device construction have enabled even smaller flash-memory cards. An extension of SD known as microSD yields a flash-memory card about the size and thickness of a US dime coin, although the microSD card is rectangular and lighter than the dime. An extension of Sony's Memory Stick, known as a Memory Stick Micro (M2) is similar in size and thickness.

FIG. 1 shows several prior-art flash-memory cards. SD card 36 is a Secure Digital (SD) card that has a series of metal contacts 14 exposed along one edge. Metal contacts 14 mate with socket contacts in a host when SD card 36 is inserted into a host. Metal contacts 14 include power, ground, and other signals such as data lines, a clock, command, and card-detect signals.

Memory Stick 38 is a Memory Stick Duo or PRO Duo flash-memory card. SD card 36 and Memory Stick 38 are mid-generation devices and are larger in size, being roughly an inch in length and about 2 mm in thickness.

Newer-generation devices include Memory Stick Micro 32 (M2) and microSD card 34. These devices are about a quarter of the size of earlier-generation cards, such as SD card 36 and Memory Stick 38. MicroSD card 34 has a reduced thickness of only 1 mm, while Memory Stick Micro 32 is 1.2 mm in thickness. Metal contacts 16 are smaller, and may have longer contacts for power and ground to connect power and ground before other signals are connected during insertion.

FIG. 2 highlights a problem with the smaller flash-memory cards. The extremely small size of microSD card 34 (the size of a fingernail) makes accidental loss of the card more likely than for the larger cards. MicroSD card 34 could slip out of a person's hand, or pass through a small hole in a person's pocket without notice. Memory Stick Micro 32 or microSD card 34 could easily be lost on a messy desk at work or at home.

Loss of a flash memory card is quite undesirable, not just due to the cost of the flash device itself. The data stored on the flash memory card may be critical data. Loss of such critical data may lead to identity theft or compromised trade secrets. Address and phone lists of customers could be useful to a competitor. A spammer may use a list of email addresses found on a lost flash-memory card, to the embarrassment of the owner of the lost flash-memory card.

MicroSD card 34 could be inserted into an adapter for a larger format, such as an adapter between microSD card 34 and SD card 36. However, the size of SD card 36 is still somewhat small. Credit-card-sized carriers are available for carrying a car key in a person's wallet for emergencies, and a similar carrier could be used for carrying SD card 36 in a wallet. However, the many standards for micro flash-memory cards make a multi-standard wallet carrier more desirable.

What is desired is a multi-standard carrier that fits in a person's wallet. A multi-standard carrier that can carry multiple kinds of flash-memory cards is desirable. A multi-standard carrier that has a size similar to a credit card is desirable so that the carrier could be placed into a person's wallet in place of a credit card. A credit-card-sized carrier is desirable for transporting micro flash-memory cards so that the micro flash-memory cards are not lost during transport.

DETAILED DESCRIPTION

The present invention relates to an improvement in flash-memory-card wallet carriers. The following description is presented to enable one of ordinary skill in the art to make and use the invention as provided in the context of a particular application and its requirements. Various modifications to the preferred embodiment will be apparent to those with skill in the art, and the general principles defined herein may be applied to other embodiments. Therefore, the present invention is not intended to be limited to the particular embodiments shown and described, but is to be accorded the widest scope consistent with the principles and novel features herein disclosed.

Figure 3:
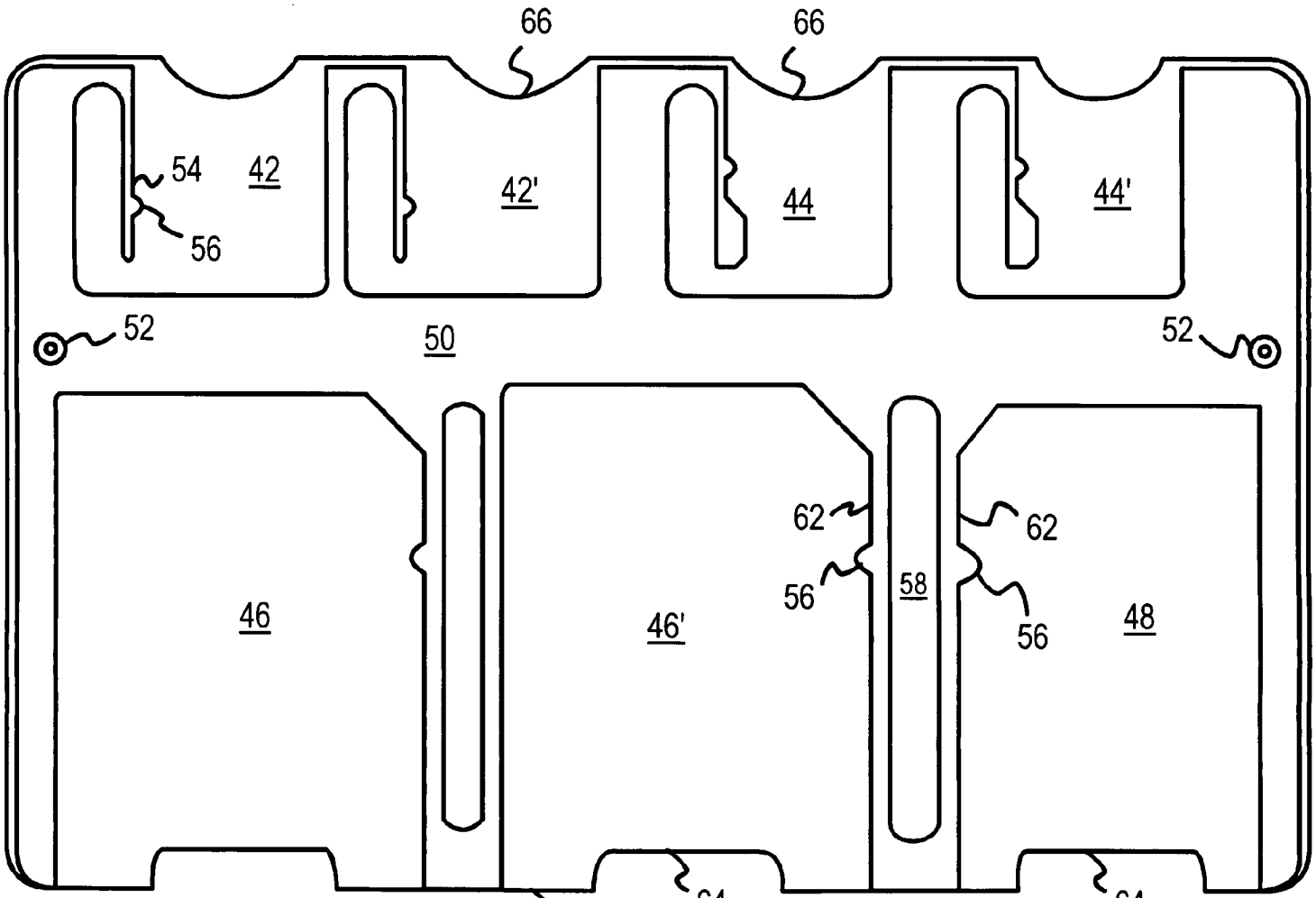
FIG. 3 shows a multi-standard flash-memory-card carrier with its top cover removed.

FIG. 3 shows a multi-standard flash-memory card carrier with its top cover removed. A multi-standard flash-memory card carrier has a length and width that are approximately the same as that of a credit card, 8.5 cm by 5.4 cm, although the dimensions do not have to be exactly the same as a credit card, but could be smaller or slightly larger and still fit within a plastic sleeve for credit cards that are commonly found in wallets.

The thickness of the multi-standard flash-memory card carrier is greater than the thickness of a credit card so that the multi-standard flash-memory card carrier can carry flash-memory cards that are up to 2 mm thick. For example, the multi-standard flash-memory-card carrier may be 3 or 4 mm thick, and still fit within a wallet.

The multi-standard flash-memory-card carrier has three larger bays 46, 46', 48 and four micro bays 44, 44', 42, 42', allowing up to 7 flash-memory cards to be carried at one time. Carrier spine 50 is sandwiched between bottom plate 70 and top plate 30 (not shown). Carrier spine 50 has seven openings that form bays 46, 46', 48, 44, 44', 42, 42.

SD card bays 46, 46' are each sided to accept SD card 36, while Memory Stick Duo/PRO Duo bay 48 is sided to accept Memory Stick 38. One side of the multi-standard flash-memory-card carrier can thus accept up to 3 of the larger flash-memory-card.

MicroSD bays 44, 44' are each sized to accept microSD card 34, while Memory Stick Micro (M2) bays 42, 42' are each sized to accept Memory Stick Micro 32. Up to four micro flash-memory cards can be carried at one time by the multi-standard flash-memory-card carrier. The larger credit-card size of the multi-standard flash-memory-card carrier helps prevent inadvertent loss of the tiny microSD card 34 or Memory Stick Micro 32, and allows for convenient transport in a person's wallet, along with other credit cards, ID cards, family photographs, or other items carried in a wallet.

Figure 1:
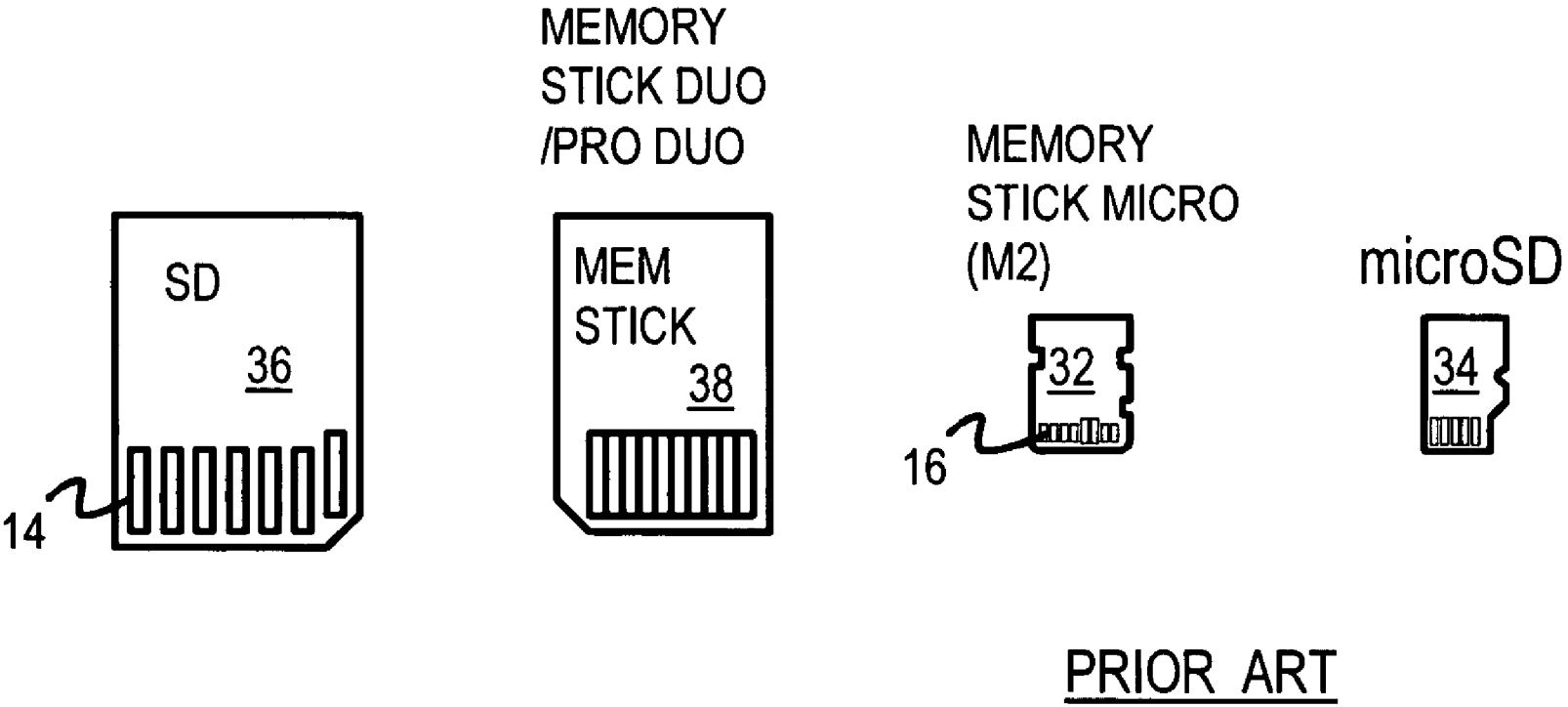
PRIOR ART FIG. 1
FIG. 1 shows several prior-art flash-memory cards.
Figure 2:
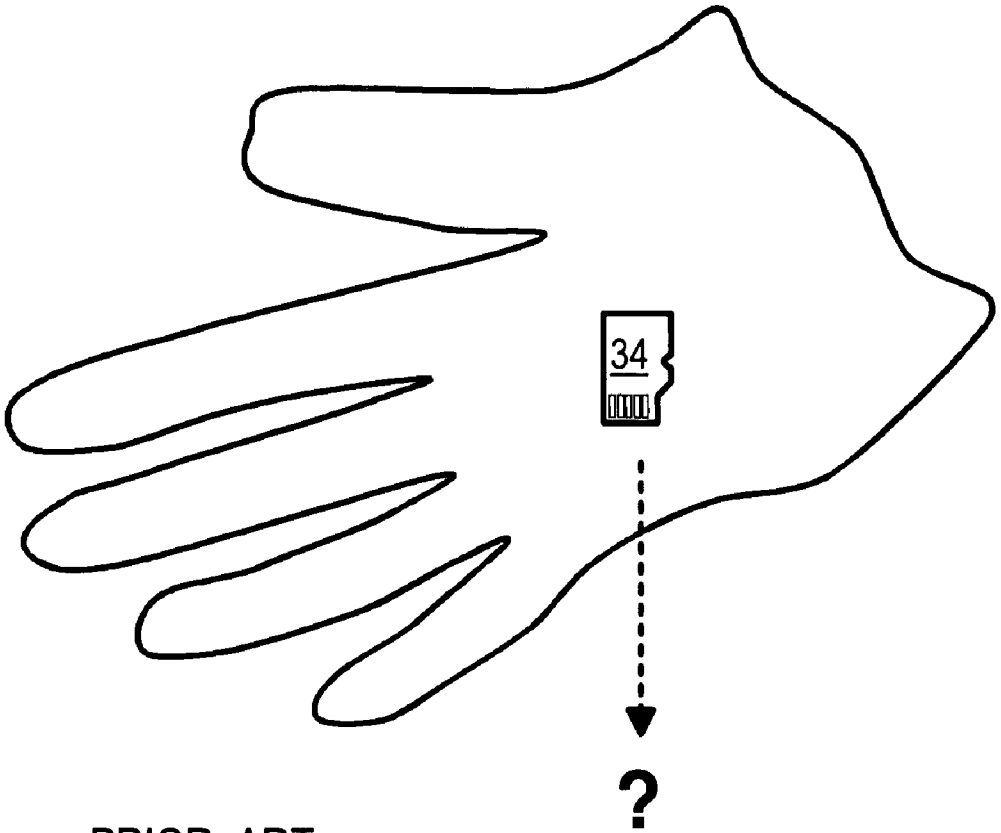
PRIOR ART FIG. 2
FIG. 2 highlights a problem with the smaller flash-memory cards.

The flash-memory cards carried in the multi-standard flash-memory-card carrier could slip out and still be lost if they were not secured. Spring-clip fingers 54 are formed on carrier spine 50 to secure flash-memory cards being carried. Each spring-clip finger 54 has spring-clip tab 56 formed thereon. Spring-clip tab 56 is a rounded extension or knob that is sized to fit within a notch on the side of microSD card 34 (FIG. 1). When microSD card 34 is inserted into microSD bay 44, spring-clip finger 54 is deformed and flexes to the side to allow the straight edge of microSD card 34 to pass along. Once the notch in the side of microSD card 34 aligns with spring-clip tab 56, then spring-clip finger 54 snaps back into a less-strained or less deformed position to lock spring-clip tab 56 into the notch. Thus microSD card 34 is secured into the multi-standard flash-memory-card carrier.

Once microSD card 34 is inserted into microSD bay 44, microSD card 34 may be removed by the person pulling microSD card 34 outward, gripping microSD card 34 at micro gripping cutouts 66 with the person's fingers. Memory Stick Micro 32 also has such notches that accept spring-clip tab 56 when Memory Stick Micro 32 is fully inserted into Memory Stick Micro (M2) bay 42.

The larger SD card bays 46, 46' and Memory Stick Duo/PRO Duo bay 48 have spring sides 62 formed around oval cavity 58 in carrier spine 50. Spring-clip tabs 56 move inward into oval cavity 58 as spring side 62 are deformed inward by the straight sides of SD card 36 or Memory Stick 38 until the notch aligns with spring-clip tab 56 and spring side 62 can snap back into a less-deformed position. Thus SD card 36 and Memory Stick 38 are secured into the multi-standard flash-memory-card carrier by spring-clip tab 56 fitting into notches on the flash-memory cards.

SD card 36 may be removed by the person pulling SD card 36 outward, gripping SD card 36 at larger gripping cutouts 64 with the person's fingers. Memory Stick 38 may be removed in a similar manner using larger gripping cutouts 64 in Memory Stick Duo/PRO Duo bay 48.

Figure 5:
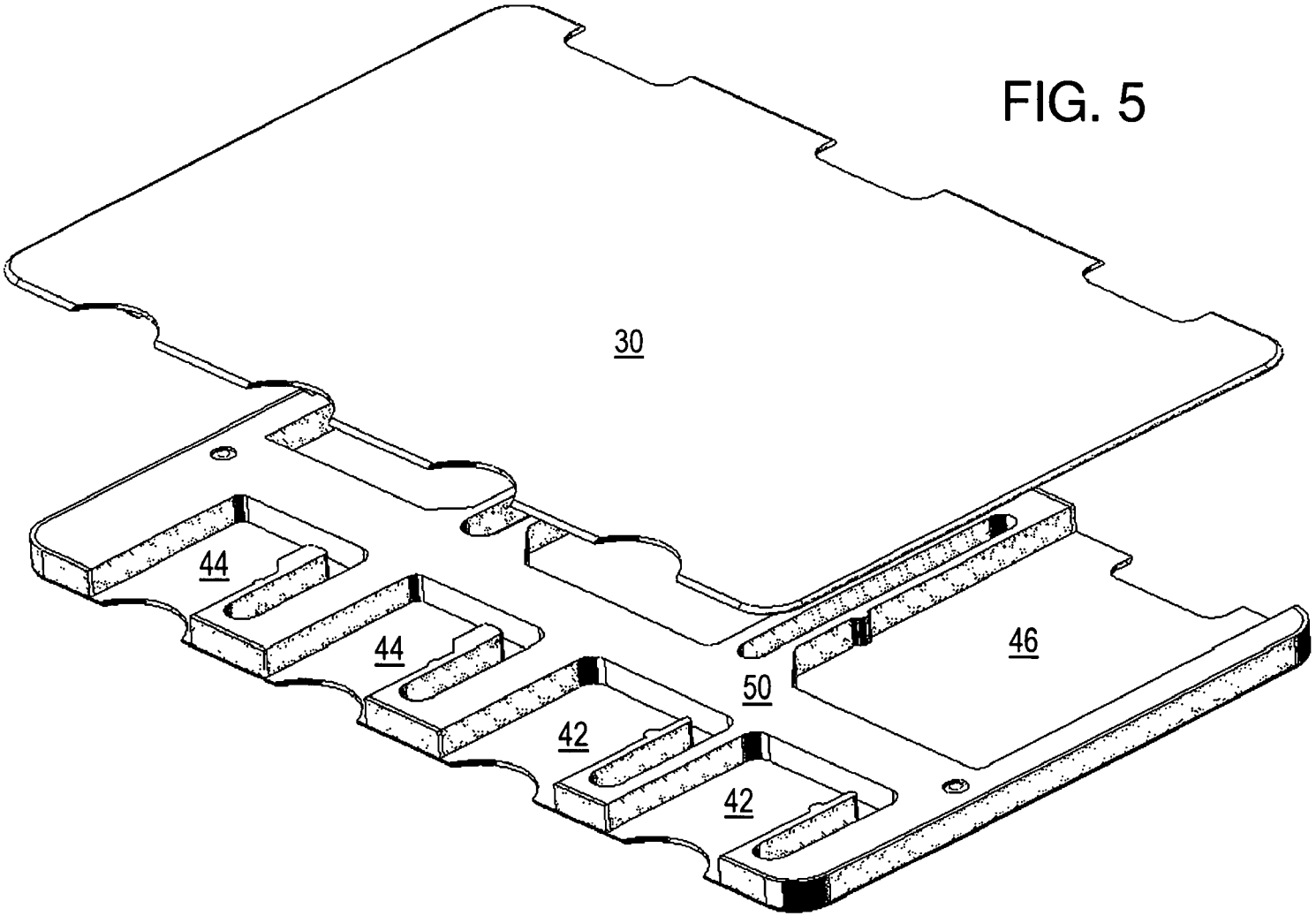
FIG. 5 is an exploded view of the multi-standard flash-memory-card carrier showing the micro bays.

Cover connection points 52 may be a weld joint, glue tab, plastic clip, screw, bolt, alignment hole, or other mechanism to connect carrier spine 50 to bottom plate 70 and/or to top plate 30 (FIG. 5). Ultrasonic welding may be used to melt cover connection points 52 when bottom plate 70 or top plate 30 is pressed into carrier spine 50, forming a bond.

Figure 4A:
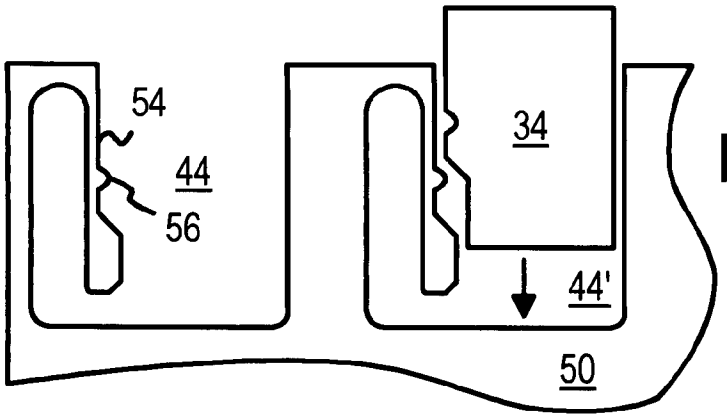
FIGS. 4A-C highlight insertion of a microSD card into a microSD bay in the multi-standard flash-memory-card carrier.
Figure 4B:
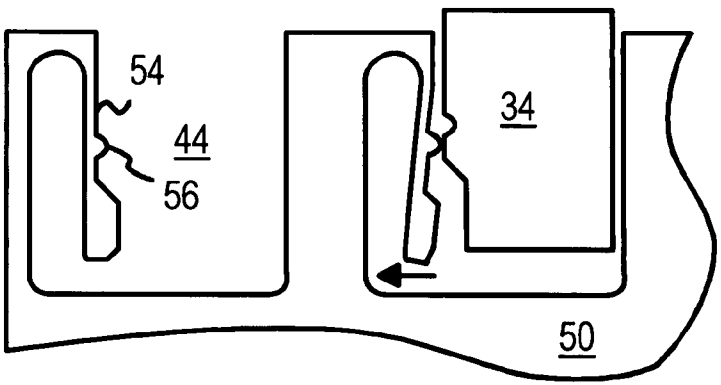
Figure 4C:
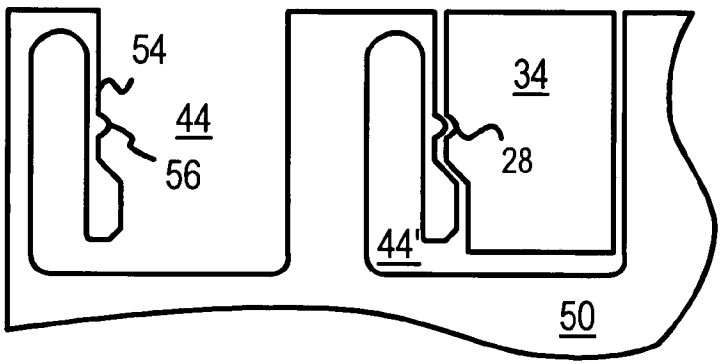

FIGS. 4A-C highlight insertion of a microSD card into a microSD bay in the multi-standard flash-memory-card carrier. In FIG. 4A, microSD card 34 is being pushed into microSD bay 44' in carrier spine 50 (only partially shown). In FIG. 4B, as microSD card 34 is pushed further into microSD bay 44' past spring-clip tab 56, spring-clip finger 54 is deformed outward to the side as spring-clip tab 56 slides along the straight side of microSD card 34. In FIG. 4C, once microSD card 34 is pushed farther into microSD bay 44', notch 28 in the side of microSD card 34 aligns with spring-clip tab 56, allowing spring-clip tab 56 to snap into notch 28. The pressure from deformation of spring-clip finger 54 locks spring-clip tab 56 into notch 28. Thus microSD card 34 is secured into microSD bay 44' by spring-clip finger 54 and spring-clip tab 56.

The sides of spring-clip tab 56 can be tapered to facilitate a person to more easily pull microSD card 34 out of microSD bay 44'.

FIG. 5 is an exploded view of the multi-standard flash-memory-card carrier showing the micro bays. Top plate 30 is to be attached to carrier spine 50 during assembly, while still allowing spring-clip fingers 54 (FIG. 3) to move. MicroSD bays 44, 44' and Memory Stick Micro (M2) bays 42, 42' are visible on this edge of the multi-standard flash-memory-card carrier.

Figure 6:
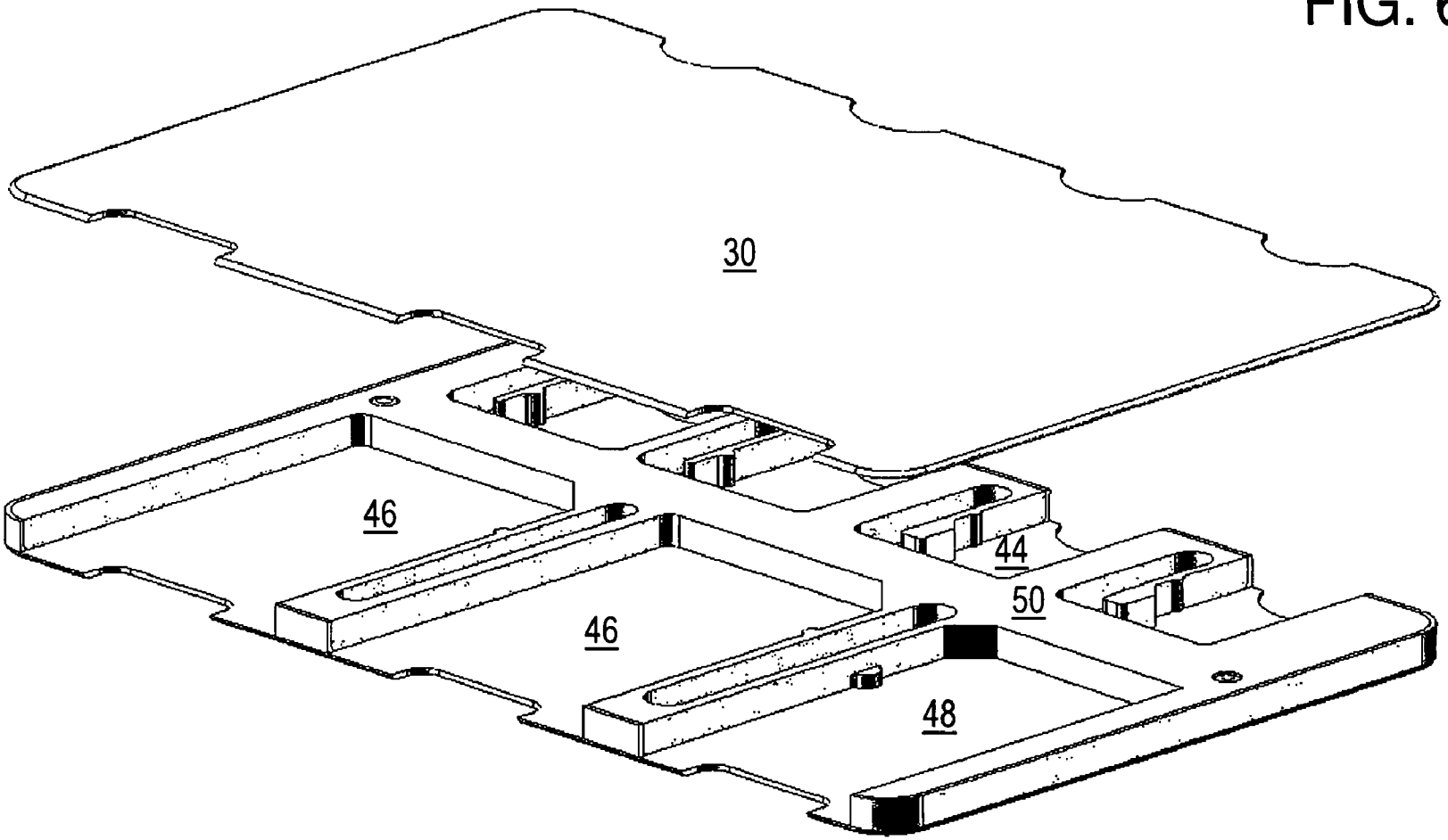
FIG. 6 is an exploded view of the multi-standard flash-memory-card carrier showing the larger bays.

FIG. 6 is an exploded view of the multi-standard flash-memory-card carrier showing the larger bays. Top plate 30 is to be attached to carrier spine 50 during assembly, while still allowing spring sides 62 to move. SD card bays 46, 46' and Memory Stick Duo/PRO Duo bay 48 are visible on this edge of the multi-standard flash-memory-card carrier. Memory Stick Micro (M2) bay 42 is on the other side of the multi-standard flash-memory-card carrier.

Since the notch on Memory Stick 38 is only shallow, spring-clip tab 56 on spring side 62 in Memory Stick Duo/PRO Duo bay 48 is only shallow, as can be seen in FIG. 6. Other spring-clip tabs 56 are more prominent in SD card bays 46, 46' and Memory Stick Micro (M2) bay 42.

Figure 7:
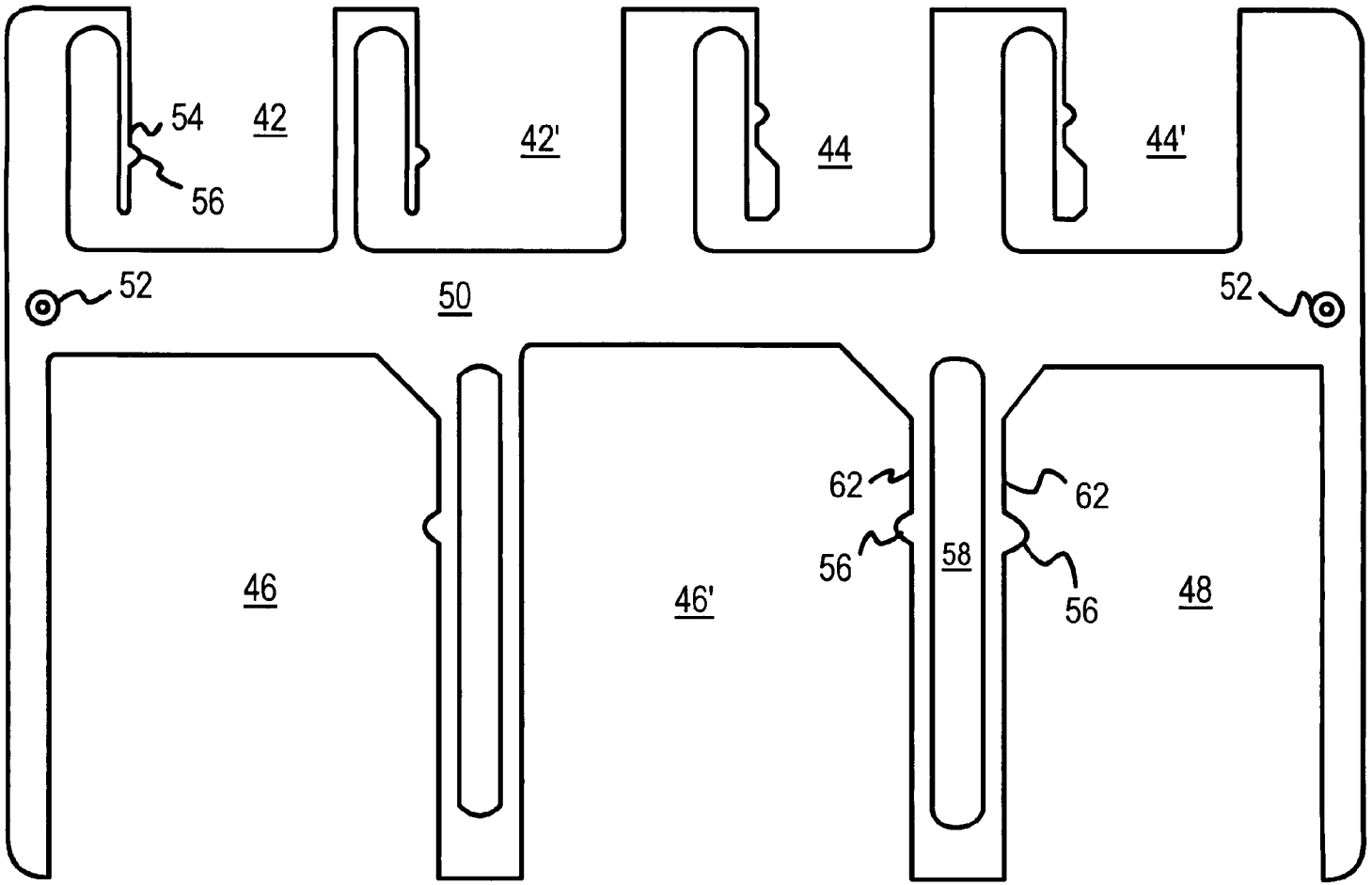
FIG. 7 shows the carrier spine in more detail.

FIG. 7 shows the carrier spine in more detail. Top plate 30 and bottom plate 70 are not shown in FIG. 7, but are attached by welding to cover connection points 52. Spring-clip fingers 54 and spring sides 62 move sideways when flash-memory cards are being inserted due to the force of the straight sides of the flash-memory cards on spring-clip tabs 56. Spring side 62 moves inward into oval cavity 58.

Figure 8:
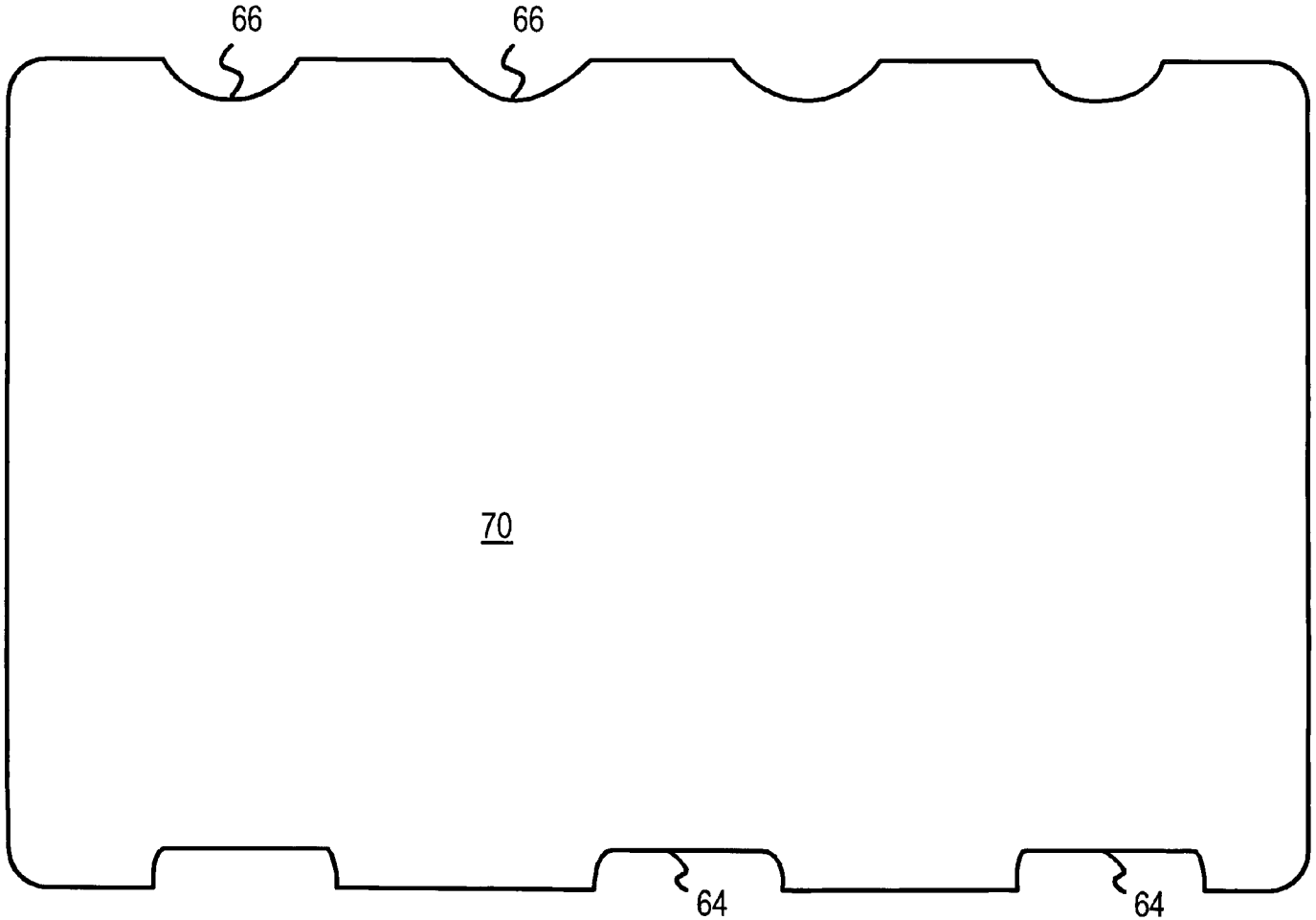
FIG. 8 shows the bottom plate with micro gripping cutouts.

FIG. 8 shows the bottom plate with micro gripping cutouts. Bottom plate 70 may be a plastic sheet having the length and width of a credit card. Micro gripping cutouts 66 are formed on one edge, while larger gripping cutouts 64 are formed on the opposing edge, to allow a person to better grip microSD card 34, Memory Stick Micro 32, SD card 36, or Memory Stick 38 to pull it out during removal.

Alternate Embodiments

Several other embodiments are contemplated by the inventors. For example, various indicia or patterns may be printed or formed on bottom plate 70 or top plate 30. A writable area may be formed to allow a person to write information, such as the person's phone number if the multi-standard flash-memory-card carrier is lost. Promotional items may be printed on the carrier. A compass, magnifying glass, or USB device may be added to the carrier. While flash memory cards have been described, the multi-standard flash-memory-card carrier could carry other devices that fit the flash-memory-card form factors, such as WiFi card devices.

While a multi-standard flash-memory-card carrier with two SD card bays 46, 46' and only one Memory Stick Duo/PRO Duo bay 48 has been described, the multi-standard flash-memory-card carrier could have two or three Memory Stick Duo/PRO Duo bays 48, or no Memory Stick Duo/PRO Duo bay 48 and three SD card bays 46. Likewise, different combinations and arrangements of microSD bay 44 and Memory Stick Micro (M2) bay 42 could be substituted. Bays for other kinds of flash-memory cards could be substituted, such as for future flash-memory-card standards.

While bottom plate 70 has been described as a separate plastic sheet from carrier spine 50, carrier spine 50 and bottom plate 70 could be formed together, such as by being a single molded piece, although spring-clip tabs 56 and spring side 62 in carrier spine 50 need to be movable and not bonded to bottom plate 70 to allow movement of the spring mechanism. While plastic plates have been described, carrier spine 50, bottom plate 70, and top plate 30 could be made from various kinds of plastic, metal, or various combinations. Clear plastic could be used for top plate 30 and/or bottom plate 70, or opaque plastic could be used. Additional pieces could be added. The multi-standard flash-memory-card carrier could be slid into a cover, or could have a removable cover, or attached to a lanyard to be worn as an ID card.

The background of the invention section may contain background information about the problem or environment of the invention rather than describe prior art by others. Thus inclusion of material in the background section is not an admission of prior art by the Applicant.

Any advantages and benefits described may not apply to all embodiments of the invention. When the word "means" is recited in a claim element, Applicant intends for the claim element to fall under 35 USC Sect. 112, paragraph 6. Often a label of one or more words precedes the word "means". The word or words preceding the word "means" is a label intended to ease referencing of claim elements and is not intended to convey a structural limitation. Such means-plus-function claims are intended to cover not only the structures described herein for performing the function and their structural equivalents, but also equivalent structures. For example, although a nail and a screw have different structures, they are equivalent structures since they both perform the function of fastening. Claims that do not use the word "means" are not intended to fall under 35 USC Sect. 112, paragraph 6. Signals are typically electronic signals, but may be optical signals such as can be carried over a fiber optic line.

The foregoing description of the embodiments of the invention has been presented for the purposes of illustration and description. It is not intended to be exhaustive or to limit the invention to the precise form disclosed. Many modifications and variations are possible in light of the above teaching. It is intended that the scope of the invention be limited not by this detailed description, but rather by the claims appended hereto.

We claim:

1. A multi-standard flash-memory-card carrier comprising:

a top cover;

a bottom cover;

a carrier spine, situated between the top cover and the bottom cover;

wherein the top cover and the bottom cover are fixed to the carrier spine;

a plurality of large openings formed on the carrier spine, the large openings for receiving large flash cards;

a plurality of micro openings formed on the carrier spine, the micro openings for receiving micro flash cards; wherein each of the micro flash cards includes a notch; and spring-clip tabs, formed on the carrier spine, for fitting into notches on edges of the micro flash cards, wherein the spring-clip tabs secure the micro flash cards into the carrier spine to prevent inadvertent loss;

wherein each of the large openings is larger than each of the micro openings;

wherein the micro openings are not able to receive the large flash cards;

wherein the carrier spine, the top cover, and the bottom cover, when assembled into the multi-standard flash-memory-card carrier, are sized to fit in a plastic sleeve for receiving credit cards in a wallet, whereby both micro flash cards and large flash cards are carried in the wallet by the multi-standard flash-memory-card carrier.

2. The multi-standard flash-memory-card carrier of claim 1 further comprising:

spring-clip fingers, supporting the spring-clip tabs and formed on the carrier spine at edges of the plurality of micro openings, for moving the spring-clip tabs during insertion of the micro flash cards and for forcing the spring-clip tabs into the notches of the micro flash cards when the micro flash cards are fully inserted into the carrier spine.

3. The multi-standard flash-memory-card carrier of claim 2 wherein the spring-clip fingers are deformable portions of the carrier spine that are situated on edges of the plurality of micro openings and are deformed away from the plurality of micro openings by the micro flash cards during insertion.

4. The multi-standard flash-memory-card carrier of claim 3 further comprising:

large spring-clip tabs, formed on the carrier spine, for fitting into notches on edges of the large flash cards, for securing the large flash cards when inserted.

5. The multi-standard flash-memory-card carrier of claim 4 further comprising:

spring sides, formed on the carrier spine, the spring sides supporting the spring-clip tabs at edges of the plurality of large openings, for moving the spring-clip tabs during insertion of the large flash cards and for forcing the spring-clip tabs into notches of the large flash cards when the large flash cards are fully inserted into the carrier spine.

6. The multi-standard flash-memory-card carrier of claim 5 wherein the spring sides surround an oval cavity in the carrier spine, the spring sides being deformed inward to reduce a size of the oval cavity during insertion of the large flash cards.

7. The multi-standard flash-memory-card carrier of claim 6 wherein the spring-clip fingers are each connected to the carrier spine at only one end of each of the spring-clip fingers, while the spring sides are connected to the carrier spine at two ends of each of the spring sides.

8. The multi-standard flash-memory-card carrier of claim 2 further comprising:

micro gripping cutouts formed on the bottom cover and on the top cover over the plurality of micro openings, for allowing a person to grip the micro flash cards for removal from the multi-standard flash-memory-card carrier.

9. The multi-standard flash-memory-card carrier of claim 2 wherein the micro flash cards comprise a micro-SecureDigital (microSD) card, wherein the plurality of micro openings are sized to receive the microSD card.

10. The multi-standard flash-memory-card carrier of claim 2 wherein the micro flash cards comprise a Memory Stick Micro card, wherein the plurality of micro openings are sized to receive the Memory Stick Micro card.

11. The multi-standard flash-memory-card carrier of claim 2 wherein the micro flash cards comprise a micro-SecureDigital (microSD) card, and a Memory Stick Micro card;

wherein the plurality of micro openings are sized to receive the microSD card and receive the Memory Stick Micro card, whereby the multi-standard flash-memory-card carrier is able to carry both the microSD card and the Memory Stick Micro card.

12. The multi-standard flash-memory-card carrier of claim 11 wherein the plurality of micro openings comprises:

a microSD bay that is sized to receive a microSD card;

a Memory Stick Micro (M2) bay that is sized to receive a Memory Stick Micro card.

13. The multi-standard flash-memory-card carrier of claim 12 wherein the plurality of large openings comprises:

a SD card bay that is sized to receive a SD card;

a Memory Stick Duo/PRO Duo bay that is sized to receive a Memory Stick Duo card.

14. The multi-standard flash-memory-card carrier of claim 13 wherein the plurality of micro openings further comprises:

a second microSD bay that is sized to receive a second microSD card;

a second Memory Stick Micro (M2) bay that is sized to receive a second Memory Stick Micro card, wherein the multi-standard flash-memory-card carrier is able to carry two microSD cards and two Memory Stick Micro cards at a same time.

15. The multi-standard flash-memory-card carrier of claim 2 wherein the plurality of large openings are formed along a first edge of the multi-standard flash-memory-card carrier;

wherein the plurality of micro openings are formed along a second edge of the multi-standard flash-memory-card carrier, wherein the second edge is opposite the first edge, wherein large openings and micro openings are on opposite edges of the multi-standard flash-memory-card carrier.

16. The multi-standard flash-memory-card carrier of claim 15 wherein the first edge and the second edge are longer than all other edges of the multi-standard flash-memory-card carrier, wherein the plurality of large openings are formed on a longest edge of the multi-standard flash-memory-card carrier.

17. A multi-standard flash-memory-card wallet carrier comprising:

a carrier spine having a length and a width approximating a length and a width of a credit card that fits within credit-card holders in a person's wallet;

a top plate that covers a top of the carrier spine;

a bottom plate that covers a bottom of the carrier spine;

a first micro opening formed by the carrier spine, the first micro opening being sized to receive a first micro-SecureDigital (microSD) card, wherein the first microSD card includes a notch on a side of the first microSD card;

a first spring-clip finger, formed by the carrier spine at an edge of the first micro opening, the first spring-clip finger being deformable by a side of the microSD card when being inserted into the first micro opening;

a first spring-clip tab, formed on the first spring-clip finger, for fitting into the notch on the side of the first microSD card, wherein the first spring-clip finger has reduced deformation when the first spring-clip tab fits into the notch;

wherein the first spring-clip finger provides a deformation force to lock the first spring-clip tab into the notch on the first microSD card;

a second micro opening formed by the carrier spine, the second micro opening being sized to receive a second micro-SecureDigital (microSD) card, wherein the second microSD card includes a notch on a side of the second microSD card;

a second spring-clip finger, formed by the carrier spine at a side of the second micro opening, the second spring-clip finger being deformable by an edge of the second microSD card when being inserted into the second micro opening;

a second spring-clip tab, formed on the second spring-clip finger, for fitting into the notch on the side of the second microSD card, wherein the second spring-clip finger has reduced deformation when the second spring-clip tab fits into the notch;

wherein the second spring-clip finger provides a deformation force to lock the second spring-clip tab into the notch on the second microSD card;

a first large opening formed by the carrier spine, the first large opening being sized to receive a large SecureDigital (SD) card;

wherein the large SecureDigital (SD) card is larger in size than the second microSD card;

a first spring side, formed by the carrier spine at an edge of the first large opening, the first spring side being deformable by a side of the large SD card when being inserted into the first large opening; and a first large spring-clip tab, formed on the first spring side, for fitting into a notch on the side of the large SD card, wherein the first spring side has reduced deformation when the first spring-clip tab fits into the notch;

wherein the first spring side provides a deformation force to lock the first spring-clip tab into the notch on the large SD card;

whereby the multi-standard flash-memory-card wallet carrier carries two microSD cards and one large SD card.

18. The multi-standard flash-memory-card wallet carrier of claim 17 further comprising:

a second large opening formed by the carrier spine, the second large opening being sized to receive a large MemoryStickDuo card;

a second spring side, formed by the carrier spine at an edge of the second large opening, the second spring side being deformable by a side of the large MemoryStickDuo card when being inserted into the second large opening;

a second large spring-clip tab, formed on the second spring side, for fitting into a notch on the side of the large MemoryStickDuo card, wherein the second spring side has reduced deformation when the second spring-clip tab fits into the notch;

wherein the second spring side provides a deformation force to lock the second spring-clip tab into the notch on the large MemoryStickDuo card;

a third micro opening formed by the carrier spine, the third micro opening being sized to receive a Memory Stick Micro card;

a third spring-clip finger, formed by the carrier spine at a side of the third micro opening, the third spring-clip finger being deformable by an edge of the Memory Stick Micro card when being inserted into the third micro opening;

a third spring-clip tab, formed on the third spring-clip finger, for fitting into a notch on the side of the Memory Stick Micro card, wherein the third spring-clip finger has reduced deformation when the third spring-clip tab fits into the notch;

wherein the third spring-clip finger provides a deformation force to lock the third spring-clip tab into the notch on the Memory Stick Micro card.

19. A wallet flash-card carrier comprising:

a carrier spine;

a top cover situated above the carrier spine;

a bottom cover situated below the carrier spine;

a plurality of large openings formed on the carrier spine, the large openings for receiving large flash-memory cards that are Secure Digital SD cards and Memory-StickDuo cards;

a plurality of micro openings formed on the carrier spine, the micro openings for receiving micro flash-memory cards including microSD cards and Memory Stick Micro cards, wherein the micro-flash-memory cards include notches;

wherein the micro openings are smaller than the large openings and are not able to receive the large flash-memory cards;

wherein the carrier spine, the top cover, and the bottom cover, when assembled into the wallet flash-card carrier, are sized to fit in a plastic sleeve for receiving credit cards in a wallet;

spring-clip tabs means, formed on the carrier spine, for fitting into the notches on edges of the micro flash-memory cards, and for securing the micro flash-memory cards into the carrier spine;

spring-clip finger means, supporting the spring-clip tabs means and formed on the carrier spine at edges of the plurality of micro openings, for moving the spring-clip tabs means during insertion of the micro flash-memory cards and for forcing the spring-clip tabs means into the notches of the micro flash-memory cards when the micro flash-memory cards are fully inserted into the carrier spine; and micro gripping cutout means, formed on the bottom cover and on the top cover over the plurality of micro openings, for allowing a person to grip the micro flash-memory cards for removal from the wallet flash-card carrier, whereby both micro flash-memory cards and large flash-memory cards are carried in the wallet by the wallet flash-card carrier.

* * * * *